United States Patent [19]

Kramer

[11] Patent Number: 4,865,653

[45] Date of Patent: Sep. 12, 1989

[54] ZINC PHOSPHATE COATING PROCESS

[75] Inventor: Linda S. Kramer, Troy, Mich.

[73] Assignee: Henkel Corporation, Ambler, Pa.

[21] Appl. No.: 115,221

[22] Filed: Oct. 30, 1987

[51] Int. Cl.[4] ..... C23C 22/12

[52] U.S. Cl. ..... 204/38.1; 148/254; 148/255; 148/258; 148/262

[58] Field of Search ..... 148/6.15 T

[56] References Cited

U.S. PATENT DOCUMENTS

| | | | |
|---|---|---|---|
| 2,743,204 | 4/1956 | Russel | 148/6.15 T |
| 4,402,765 | 9/1983 | Goto | 148/6.15 T |

FOREIGN PATENT DOCUMENTS

| | | |
|---|---|---|
| 0064790 | 11/1982 | European Pat. Off. . |
| 0156823 | 3/1986 | European Pat. Off. . |
| 0175606 | 3/1986 | European Pat. Off. . |
| 0261597 | 3/1988 | European Pat. Off. . |
| 1172741 | 2/1959 | France . |
| 0963540 | 8/1964 | United Kingdom . |

*Primary Examiner*—Sam Silverberg

*Attorney, Agent, or Firm*—Ernest G. Szoke; Wayne C. Jaeschke; Norvell E. Wisdom

[57] ABSTRACT

The present invention relates to a composition and process for metal finishing involving the formation of zinc phosphate coatings of desired morphology on a ferrous surface. The inclusion of a hydroxylamine agent in the phosphating bath expands the range of zinc concentrations over which the desired coating morphology is obtained. Zinc and aluminum surface can also be coated with this composition and process.

33 Claims, No Drawings

ZINC PHOSPHATE COATING PROCESS

BACKGROUND OF THE INVENTION

Current day phosphate coating solutions are dilute solutions of phosphoric acid and other chemicals which are applied to the surface of metals; the surface of the metal reacts with the solution and forms an integral layer (on the surface of the metal) of substantially insoluble amorphous or crystalline phosphate coating. Crystalline coatings result if zinc or similar divalent metals other than ferrous ion are present. Depending on the characteristics of the coating, it may function to enhance corrosion resistance, wear resistance or electrical resistance; as a base for the application of a second coating (e.g., paint); or as a vehicle to retain a lubricant on the coated surface preparatory to cold forming.

Certain of these solutions have achieved widespread commercial use. Such solutions typically include phosphate ions, zinc and/or manganese ions and typically one or more of the following ions: nickel, cobalt, copper, nitrate, nitrite, chlorate, fluoborate or silicofluoride. The art has been able to form phosphate coatings since about 1917, and there have been successive discoveries of the effects of the nitrate, copper, nickel, fluoborate, and silicofluoride ions on the coating ability of such solutions made through the years. Presently, metal surfaces are typically provided with a phosphate coating by being treated in the following process sequence: (1) cleaning; (2) conditioning; (3) phosphating; and (4) post-treating. Rinses are usually employed between steps to avoid drag-in to the next stage. Such processes and solutions for forming conversion coatings on metal surfaces are well known and have been described, for example, in "Metal Handbook", Volume II, 8th Edition, pages 529–693 (1972), the contents of which are specifically incorporated herein by reference. Despite these advances, the best present day formulations are troublesome in certain respects and accordingly there is a continuing demand for still further improvements in the compositions and processes. In particular, known processes are difficult to control, form undesirably high coating weights, cause the formation of scale on processing equipment, and require replenishment as two or more separate additions. Such improvements are still being sought particularly in ferrous-, zinc- and aluminum-based substrates employed in automotive paint-base applications.

It is recognized that there are distinct types of crystal morphologies that can be produced on ferrous surfaces by zinc phosphate coating solutions. The crystalline structure may be platelet, columnar or nodular in form when examined with an electron microscope. The platelet structure resembles relatively large plates or flakes of crystalline material. The columnar configuration resembles smaller column shaped crystals, and the nodular configuration resembles uniformly disposed small nodular shaped crystals. The latter two configurations are generally preferred for paint base applications on ferrous surfaces because they achieve equivalent or better performance with respect to paint adhesion and physical tests compared to the platelet configuration. The columnar and nodular coatings are also lower in coating weight which is beneficial where cathodic electropainting is to be employed.

It has been recognized that the columnar and nodular forms are obtained by employing baths with zinc concentrations at relatively low levels. See for example U.S. Pat. No. 4,330,345 and U.S. Pat. No. 4,419,199. One of the problems encountered is that if the zinc levels increase in the bath, for example due to dissolution of zinc from galvanized parts or due to process control problems, the form of the coating will rapidly change to the less desirable platelet morphology. It would therefore be desirable to have a coating bath and process which broadens the range of acceptable zinc levels which will still form the desired columnar and/or nodular coatings.

Another problem inherent in other phosphating processes is the formation of scale on heat exchangers and on the piping and related equipment used to circulate and/or apply the solution to the parts which must be periodically removed to maintain both heating efficiency and/or coating quality. Moreover, many processes currently employed use nitrite as accelerator and therefore require the replenishment of the phosphating solutions from two separate replenishing packages because nitrite would decompose in the concentrated acidic replenisher. Finally, modern phosphating processes must be capable of successfully forming a phosphate coating on galvanized and aluminum surfaces in addition to ferrous surfaces.

The present invention solves the foregoing problems in producing the desired paint-base coating through the inclusion of a hydroxylamine agent in the zinc phosphate solution.

Hydroxylamine agents have been disclosed for use in certain zinc phosphate solutions. For example, U.S. Pat. No. 2,743,204, issued Apr. 24, 1956 to Russell discloses a metal (iron, zinc and manganese) phosphate coating solution having a pH of about 1.9 to about 3.5. The patentee states that the coating weight resulting from such conventional aqueous acidic phosphate solutions may be increased by the addition of small quantities of certain organic chelating agents. Hydroxylamine is recited as one of many specific oxidizing agents which can be used in such coatings. This patent is directed only to heavy phosphate coatings desirable for base corrosion resistance or cold forming purposes and does not contemplate paint base applications. The specific levels of zinc and hydroxylamine exemplified yield platelet morphology and the inventor does not recognize the potential benefits of the hydroxylamine to produce columnar and/or nodular coatings for paint base applications.

U.S. Pat. No. 2,298,280, issued Oct., 1942 to Clifford, et al. discloses the use of hydroxylamine in a coating acid phosphate solution to accelerate the coating action of the solution. Again, the specific levels of zinc and hydroxylamine exemplified yield platelet morphology and the inventor does not recognize the potential benefits of the hydroxylamine to produce columnar and/or nodular coatings.

U.S. Pat. 4,149,909, issued Apr. 17, 1979 to Hamilton discloses iron phosphate coating processes for applying a moderate coating weight on ferrous metal surfaces by spraying or dipping in the solution. The process employs a combination accelerator comprising hydroxylamine sulfate and an oxidizing agent such as a chlorate or a bromate. The resulting amorphous coatings do not relate to the crystalline coatings of a zinc phosphate system.

U.S. Pat. No. 4,003,761, issued Jan. 18, 1977 to Gotta, et al. discloses a process for applying a phosphate coating to a ferric surface by spraying. The patentee states that an improvement in the production of phosphate coatings by spraying acid solutions based on alkali metal and/or ammonium orthophosphate is accomplished by the addition of 0.05 to 1 grams per liter of a short-chain alklolamine and from about 0.01 to 1.5 grams per liter of a non-ionic wetting agent. The patentee further states that oxidizing or reducing agent accelerators can be employed; he includes hydroxylamine salts as one of the many groups of such compositions that may be employed. It is stated that the pH value of the solution is in the range of 4.3 to 6.5, that the duration of treatment for the spray is 0.5 to 5 minutes and that the process can be carried out at temperatures between 40° C. and 95° C., preferably 50° C. to 70° C. Amorphous coatings result from this process.

U.S. Pat. No. 2,702,768, issued Feb. 22, 1955 to Hyans, et al. discloses that the coating provided by "non-coating phosphate" solutions can be improved by employing hydroxylamine in the solution. "Non-coating phosphates" are specified as being alkali metal phosphates such as sodium phosphate and potassium phosphate, as well as ammonium phosphate. It is suggested that the hydroxylamine be used at a level of 0.1% to 0.5% and at a pH of about 4.2 to 5.8. Again, amorphous coatings are the result.

U.S. Pat. No. 3,615,912, issued Oct. 26, 1971 to Mainz-Kostheim, et al. discloses treating and coating solutions containing alkali- or ammonium-based orthophosphates with hydroxylamine being an optional ingredient. Amorphous coatings result from this process.

U.S. Pat. No. 4,220,486, issued Sept. 2, 1980 to Matusushima, et al. (assigned to Nihon Parkerizing Company, Japan) describes an alkali phosphate conversion coating solution containing stannous ions and fluoride ions and optionally pyrazole compounds, hydroxylamine compounds and hydrazine compounds at a level of 0.2 grams per liter to about 5 grams per liter. This process does not produce a crystalline zinc phosphate coating.

A treatment solution that attempts to control the crystal morphology is disclosed in European patent application No. 0,175,606, based upon French patent application FR No. 8412878, filed Aug. 16, 1984. The use of a hydroxylamine agent is not suggested.

In none of the prior art is there even a general teaching or suggestion that the use of hydroxylamine critically influences crystal morphology in any fashion.

SUMMARY OF THE INVENTION

It has now been found that where predominantly columnar and/or nodular coatings are desired the inclusion of a hydroxylamine agent in a zinc phosphate solution enhances the process and broadens the range of zinc content at which the desired coating is obtained. Additionally, scaling of heat exchangers and process equipment is reduced and the solution can be replenished by a single package replenisher concentrate.

DETAILED DESCRIPTION OF THE INVENTION

The improved zinc phosphate type conversion coating solution and process of the present invention employ a hydroxylamine agent. The agent, when present in sufficient quantities, alters the morphology of the resulting coating from platelet to columnar and/or nodular and achieves this result over a broadened range of zinc concentrations.

The zinc phosphate type conversion coating solutions to which this invention applies includes any such solution which will form a columnar and/or nodular coating on a ferrous surface. Any of the conventionally known additives for such solutions may be present unless they detrimentally affect the formation of a uniform coating of the desired morphology. For example, the presence of nitrite in substantial amounts would adversely affect the permissible range of zinc concentrations.

The presence of hydroxylamine increases the maximum permissible zinc to phosphate ratio to about 0.125 to 1 with values as high as 0.27 to 1 being possible. The prior art has generally taught the maximum ratio for so called "low zinc" processes to be 1:12 or only 0.08 to 1. In terms of the zinc concentration, levels as high as about 0.2 wt. % are permissible whereas in the prior art processes, platelet morphology results even at zinc levels well below 0.1 wt. % (1.0 g/l). For purposes of allowing a safety factory in controlling the process to obtain the desired morphology, a zinc level of from 0.045 to 0.11 wt. % is preferred.

The expanded tolerance for zinc is important since control cannot always be tightly maintained in practice, especially where galvanized or partly galvanized parts are being treated in addition to the ferrous parts. Zinc content may increase as a result of the attack of the solution on the galvanized surface.

The hydroxylamine can be added to the coating solution in any suitable form, and from any conventional source. The term "hydroxylamine agent", as used herein, means any compound that provides hydroxylamine or a derivative thereof such as a hydroxylamine salt or complex. Suitable examples include hydroxylamine phosphate, nitrate, sulfate, or mixtures thereof. More preferably, the hydroxylamine agent or source is a coating concentrate formulated with hydroxylamine sulfate ("HS"), a stable salt of hydroxylamine. Hydroxylamine sulfate may be represented by the formula $(NH_2OH)_2 \cdot H_2SO_4$ or $(NH_3OH)_2 \cdot SO_4$. Throughout this specification, quantities of hydroxylamine are expressed as hydroxylamine sulfate equivalent.

Any effective amount of hydroxylamine may be employed in these coating baths. By the term "effective amount", as used herein, is meant an amount sufficient to cause the solution to produce a coating wherein the morphology is predominantly columnar and/or nodular as opposed to platelets. That is, when two substantially identical phosphate coating solutions or baths (differing only in that one contains an effective amount of hydroxylamine and the other does not) are compared, the solution with the effective amount of hydroxylamine agent produces predominant levels of nodular and/or columnar crystals on the surface of the ferrous article while the other does not.

Preferably, the solution employed in the process of the present invention contains a concentration of hydroxylamine agent (calculated as hydroxylamine sulfate equivalent) of from about 0.05 to 5 wt. percent. Hydroxylamine sulfate levels are typically in the range of from about 0.05 to about 1 percent, more preferably about 0.05 percent to about 0.3 percent, still more preferably about 0.1 percent to about 0.3 percent.

It has also been observed that the solutions of the present invention demonstrate reduced scaling under certain conditions. For example, under conditions where certain equipment (such as heat exchangers) is subject to excessive scaling, the substitution of the solutions and method of the present invention can show a dramatic reduction in the rate of scale formation, thus reducing maintenance requirements and improving heat transfer efficiency and coating quality.

The solutions and compositions employed in processes and methods of the present invention may also contain ferrous ions either by deliberate addition or through etch-type buildup. Ferrous ions may be present at levels or in amounts up to the saturation point of the ferrous ion in the bath. Amounts or levels of ferrous iron ions within the bath may be typically in the range of about 0.001 to 0.05 wt. % or preferably 0.005 to 0.05 wt. %. When present in sufficient concentrations, $Fe^{+2}$ increases the range of $Zn^{+2}$ which will produce the desired morphology at a given concentration of hydroxylamine agent. This is an added benefit of a hydroxylamine agent since it allows $Fe^{+2}$ to remain in solution, whereas in traditional nitrite baths the nitrite oxidizes the $Fe^{+2}$ to insoluble $Fe^{+3}$.

Phosphate may be employed at its art-established level. Preferred phosphate levels useful in the present invention are typically in the range of from about 0.2 to about 5 wt. percent, preferably about 0.3 to about 2.5 percent. Typically the total acid points of the bath will range from 12 to 37 with 13 - 22 most typical. The free acid points range from 0.1 to 1.0 with 0.3 to 0.4 being most typical.

It will also be appreciated that it may be desirable to perform certain other select steps both prior to and after the application of the improved phosphate coating produced by the processes and method of the present invention. For example, it may be advantageous to take steps to see that the part, workpiece or other article to be coated is substantially free of grease, dirt, or other extraneous matter. This is preferably done by employing conventional cleaning procedures and materials. These would include, for example, mild or strong alkali cleaners, acidic cleaners, and the like. Such cleaners are generally followed and/or preceded by a water rinse.

It is highly preferred to employ a conditioning step following or as part of the cleaning step, such as those disclosed in U.S. Pat. Nos. 3,310,239; 2,874,081; and 2,884,351; all of which are expressly incorporated herein by reference. These conditioning solutions typically employ condensed titanium compounds and preferably a condensed phosphate. For example, solutions comprising 0.0003–0.05% Ti (3–500 ppm Ti) and 0.01–2% sodium tripolyphosphate are suitable. In a highly preferred embodiment, such solution employs about 3–25 ppm of titanium. The conditioning step serves to provide the surface with nucleation sites which serve to reduce the grain of the subsequent phosphate coating.

After the coating is formed by application of this solution of this invention, it is advantageous to subject the coating to a post-treatment solution as conventionally taught. The solution may contain chromium (trivalent and/or hexavalent) or may be chromium-free. Chromium post-treatment solutions would include, for example, about 0.025 to about 0.1 wt. percent chromium ($Cr^{+3}$, $Cr^{+6}$, or mixtures thereof). Chromium-free rinses typically incorporate organic materials, zirconium, etc. and may also be employed. See for example, U.S. Pat. Nos. 3,975,214; 4,365,000; 4,457,790; 4,090,353; 4,433,015 and 4,157,028, all of which are expressly incorporated herein by reference.

If the post-treated part is to be electropainted the surface is preferably rinsed with deionized water to avoid undue drag-in of chemicals into the paint tank.

The phosphate processing conditions and solution parameters are selected to yield a coating weight of about 70 to 200 mg/ft$^2$. Contact times commercially available extend from 3 seconds to 2 minutes or more with 30 seconds to 2 minutes being common for processing parts on a conveyor. The phosphating solution is typically maintained in the range of about 90° to 200° F. the specific temperature selected so as to achieve the desired coating weight in the allowed contact time.

The composition and process of the present invention may be employed not only on ferrous metals and their alloys but also on surfaces of zinc or aluminum and their alloys. This feature is becoming increasingly important with the increased usage of galvanized and aluminum in the manufacturing sector.

Single package replenishers containing a hydroxylamine agent have been prepared and found stable under a broad range of temperatures.

In order to further illustrate the benefits and advantages of the present invention, the following specific examples are provided. It will be understood that the examples are provided for illustrative purposes and are not intended to be limiting of the scope of the invention as herein disclosed and as set forth in the subjoined claims.

EXAMPLE I

The following materials were combined in a 5 gallon bath:

451 g 75% $H_3PO_4$
32.4 g Reagent grade $HNO_3$
23.6 g ZnO
68.5 g nickel nitrate solution (equivalent to 29.6 g $Ni(NO_3)_2$)
118 g $Na_2CO_3$ Standard titrations* yielded a total acid of 19.2 points and a free acid of 0.3 points. The bath was aged by spray processing two racks of eight 4"×12" cleaned and conditioned cold rolled steel panels. A rack of test panels was then processed for 1 minute at 111° F. At this point, the bath contained no hydroxylamine. Nine grams of hydroxylamine sulfate (HS) were then added to the bath, and several racks were spray processed to age the bath. The hydroxylamine sulfate concentration was then adjusted and cold rolled steel panels were processed for 60 seconds at the following HS levels: 0.05–0.06%, 0.07–0.08%, 0.12–0.13%. A bath analysis showed 0.044% Ni; 0.07% Zn; and 1.48% $PO_4$.

* 10 ml aliquot titrated with 0.1N NaOH. Points=mls titrated. Indicators=phenolphthalein for total acid and bromophenol blue for free acid.

Coating morphology and coating completeness are shown in Table I. The results show that hydroxylamine was necessary for coating formation under the processing conditions employed. They also show that increasing the HS concentration caused the morphology to change from platelet to columnar.

TABLE I

RESULTS OF EXAMPLE I

| Solution | % HAS | Coating Wt. (mg/ft$^2$) | Morphology | Coating Completeness |
|---|---|---|---|---|
| 1A | 0 | Nil | — | — |
| 1B | .05–.06 | 163 | Platelet | Incomplete |
| 1C | .07–.08 | 158 | Platelet | Incomplete |

TABLE I-continued

| RESULTS OF EXAMPLE I | | | | |
|---|---|---|---|---|
| Solution | % HAS | Coating Wt. ($mg/ft^2$) | Morphology | Coating Completeness |
| 1D | .12-.13 | 123 | Columnar | Complete |

EXAMPLE II

A phosphating bath was prepared to contain the following: $Ni^{+2}$ at 0.05%; $Zn^{+2}$ at 0.06%; $PO_4^{-3}$ at 1.20%; $F^-$ at 0.06%; $NO_3^-$ at 0.05%; hydroxylamine sulfate at 0.14%; in all of the foregoing the percentage refers to weight % of the bath. The bath exhibited a total acid of 17.2 points and a free acid of 0.3 points.

Cleaned and conditioned cold rolled steel and galvanized panels were spray processed at 120°-125° F. for 60 seconds. On steel, the resulting coating was nodular and had a coating weight of 110 mgs. per sq. ft. On the hot dip galvanized, the coating was platelet and had a coating weight of 188 $mg/ft^2$.

EXAMPLE III

A phosphating bath is prepared containing the following: $Zn^{+2}$ at about 0.05%; $PO_4^{-3}$ at about 1.4%; $Ni^{+2}$ at about 0.05%; hydroxylamine sulfate at about 0.2%. The total acid is 20.0 points and free acid 0.3 points. A cleaned and conditioned cold rolled steel panel is spray processed at 115° F. for 60 seconds spraying time at a reduced spray pressure. The resulting coating is nodular and has a coating weight of about 115 milligrams per sq. ft. Additions of zinc acid phosphate are made to the bath, with each addition increasing the $Zn^{+2}$ by 0.02%. After the second addition, the crystal morphology is changed from substantially nodular to thick platelet. Adding 12 grams of ferrous sulfate to a 5 gallon bath causes the morphology to become a mixture of nodules and columnar crystals. At this point, the bath analysis shows $Zn^{+2}$ at about 0.09% and $PO_4^{-3}$ at about 1.70%.

EXAMPLE IV

A phosphating bath was prepared to contain the following: $Zn^{+2}$ at 0.075%, $PO_4^{-3}$ at 0.83%, $Ni^{+2}$ at 0.042%, $F^-$ at about 0.08%, $Fe^{+2}$ at 0.02%, and hydroxylamine sulfate at 0.5%. The total acid was 22.6 points and free acid 0.8 points. Cleaned and conditioned cold rolled steel panels were spray processed at 130° F. for 60 seconds spraying time. The resulting coating was nodular and had a coating weight of 104 $mg/ft^2$. The zinc concentration was then raised to 0.085% $Zn^{+2}$ using zinc acid phosphate. Coatings produced at the higher zinc level had columnar crystals and a coating weight of 115 $mg/ft^2$. Ferrous sulfate was then added to increase the $Fe^{+2}$ to 0.04%. Increasing the $Fe^{+2}$ caused the coatings to revert to nodular.

EXAMPLE V

A phosphating bath was prepared to contain the following: $Ni^{+2}$ at 0.05%; $Zn^{+2}$ at 0.047%; $PO_4^{-3}$ at 1.33%; $F^-$ at 0.14%; and hydroxylamine sulfate at 0.23%. The total acid was 25.8 points and free acid 0.3 points. Cleaned and conditioned panels were spray processed for 60 seconds at 137° F. On cold rolled steel, a coating containing mostly nodular and a few columnar crystals was produced with a coating weight of 174 milligrams per sq. ft. On aluminum and hot dip galvanized, coatings with platelet morphologies were produced. The aluminum and galvanized panels had coating weights of 180 milligrams per sq. ft. and 195 milligrams per sq. ft., respectively.

What is claimed is:

1. A metal finishing process for producing a predominantly nodular and/or columnar crystalline zinc-iron-phosphate coating on a ferrous surface, over a broadened range of zinc and ferrous ion concentration, which comprises: contacting the ferrous surface with an aqueous zinc phosphate conversion coating solution having a zinc/phosphate weight ratio not higher than about 0.27, an effective amount of a hydroxylamine agent to produce the crystalline structure, and wherein said solution is substantially free of nitrite and said zinc concentration is from about 0.02 to 0.2 wt. %.

2. The process of claim 1 wherein the solution is also contacted with galvanized or aluminum surfaces to form a conversion coating thereon.

3. The process of claim 1 wherein the hydroxylamine agent concentration is present in a concentration of at least about 0.05 wt. %.

4. The process of claim 3 wherein the hydroxylamine agent concentration is from about 0.05 to 5.0 wt. %.

5. The process of claim 4 wherein the hydroxylamine agent concentration is from about 0.1 to 1.0 wt. %.

6. The process of claim 1 wherein the zinc concentration is from about 0.045 to 0.11 wt. %.

7. The process of claim 1 wherein the solution additionally comprises ferrous ion.

8. The process of claim 7 wherein the ferrous ion is present in a concentration of from about 0.001 to 0.5 wt. %.

9. The process of claim 8 wherein the ferrous ion is present in a concentration of from about 0.005 to 0.05 wt. %.

10. The process of claim 1 wherein the ferrous surface is subjected to a conditioning treatment with a titanium containing conditioner prior to contact with the phosphatizing solution.

11. The process of claim 10 wherein the conditioner also contains a condensed phosphate.

12. The process of claim 1 wherein the solution is substantially free of chlorate.

13. The process of claim 1 wherein the zinc phosphate conversion coating solution additionally comprises at least one component selected from the group consisting of manganese, nickel, nitrate and simple or complex fluoride ions.

14. The process of claim 1 wherein the conversion coated surfaces is subsequently contacted with a post-treatment solution.

15. The process of claim 14 wherein the post-treatment solution is chromium-free.

16. The process of claim 14 wherein the post-treatment solution contains hexavalent chromium.

17. The process of claim 1 wherein the phosphate concentration is from about 0.3 to 2.5 wt. %.

18. The process of claim 1 wherein the solution is sprayed on the ferrous surface.

19. The process of claim 1 wherein the solution is contacted with the ferrous surface for a time and at a temperature sufficient to produce a coating weight of from about 70 to 200 $mg/ft^2$.

20. The process of claim 1 wherein the temperature of the solution on contact is from 90° to 200° F.

21. The process of claim 1 wherein the contact time is from 5 seconds to 2 minutes.

22. The process of claim 1 wherein the surface is subsequently painted.

23. The process of claim 22 wherein the painting is accomplished by cathodic electrodeposition.

24. An aqueous zinc/phosphate solution for producing columnar and/or nodular crystalline coatings on a ferrous surface over a broadened range of zinc and ferrous ion concentrations comprising a zinc phosphate solution having a zinc/phosphate ratio not higher than about 0.27, a columnar and/or nodular crystal forming effective amount of a hydroxylamine agent, the solution being substantially free of nitrite and said zinc concentration is from about 0.02 to 0.2 wt. %.

25. The solution of claim 24 wherein the hydroxylamine agent concentration is present in a concentration of at least about 0.05 wt. %.

26. The solution of claim 25 wherein the hydroxylamine agent concentration is from about 0.05 to 5.0 wt. %.

27. The solution of claim 26 wherein the hydroxylamine agent concentration is from about 0.1 to 1.0 wt. %.

28. The solution of claim 24 wherein the zinc concentration is from about 0.045 to 0.11 wt. %.

29. The solution of claim 24 wherein the solution additionally comprises ferrous ion.

30. The solution of claim 29 wherein the ferrous ion is present in a concentration of from about 0.001 to 0.5 wt. %.

31. The solution of claim 30 wherein the ferrous ion is present in a concentration of from about 0.005 to 0.05 wt. %.

32. The solution of claim 24 wherein the zinc phosphate type conversion coating solution additionally comprises at least one component selected from the group consisting of manganese, nickel, nitrate and simple or complex fluoride ions.

33. The solution of claim 24 wherein the phosphate concentration is from about 0.3 to 2.5 wt. %.

* * * * *